United States Patent [19]

Galle

[11] Patent Number: 5,013,074

[45] Date of Patent: May 7, 1991

[54] SUPPORT HANDLE

[75] Inventor: Nicola Galle, Montreal, Canada

[73] Assignee: Nykon Products Inc., Montréal, Canada

[21] Appl. No.: 481,300

[22] Filed: Feb. 20, 1990

[51] Int. Cl.[5] ..... B65D 23/10

[52] U.S. Cl. ..... 294/33; 248/145.6; 215/100 A

[58] Field of Search ..... 294/33, 27.1, 31.2, 294/32; 215/100 A; 220/85 H; 248/145.6; D7/70; D9/443

[56] References Cited

U.S. PATENT DOCUMENTS

| | | | |
|---|---|---|---|
| D. 167,671 | 9/1952 | Biggs . | |
| 899,290 | 9/1908 | Bricker | 294/33 X |
| 2,116,148 | 5/1938 | Hawley | 248/145.6 |
| 2,784,578 | 3/1957 | Southwick | 220/85 H |
| 3,021,026 | 2/1962 | Clare . | |
| 3,610,671 | 10/1971 | Conger | 294/33 |
| 4,486,043 | 12/1984 | Rais . | |
| 4,552,396 | 11/1985 | Rais . | |
| 4,606,523 | 8/1986 | Statz et al. | 294/33 X |
| 4,660,876 | 4/1987 | Weldin et al. . | |
| 4,666,197 | 5/1987 | Watson et al. . | |
| 4,817,810 | 4/1989 | Shull | 294/27.1 X |

*Primary Examiner*—Margaret A. Focarino
*Assistant Examiner*—Dean J. Kramer
*Attorney, Agent, or Firm*—ROBIC

[57] ABSTRACT

A holder is disclosed, for use in handling containers having a generally cylindrical body, such as large plastic bottles. The holder comprises a vertical stem having an upper portion and a lower portion, a handle integrally projecting from the stem, a supporting plate integrally projecting from the lower portion of the stem in a direction opposite to the handle in order to support the bottom of the container, and at least one pair of grasping arms made of resilient material, these arms integrally projecting from the stem above the supporting plate and being intended to grasp and retain the body of the container when the container is fitted in between the arms.

4 Claims, 2 Drawing Sheets

SUPPORT HANDLE

(a) FIELD OF THE INVENTION

The present invention relates to a holder for handling and eventually storing a container having a cylindrical body, like a large plastic bottle.

(b) BRIEF DESCRIPTION OF THE PRIOR ART

Most of the bottle holders known to the Applicant are provided with means for grasping the neck of a bottle and simultaneously grasping or supporting the bottom of it.

In U.S. Pat. No. 4,666,197, there is disclosed a bottle holder having a lower annular band which fits snugly over the bottom of a bottle, an upper apertured gripping member which fits over the flange of the bottle, and a handle which connects the upper gripping member and the lower band.

In U.S. Pat. No. 4,660,876, there is disclosed a bottle holder having a partially annular, flexible neck- locking portion for snappingly locking onto the annular neck of a bottle, a partial annulus member for partially encircling and securing the lower side wall portion of the bottle, and a handle connecting the locking portion with the annulus member.

In U.S. Pat. Nos. 4,552,396 and 4,486,043, there are disclosed bottle handles comprising a handle having opposite ends, one of these ends being provided with a hook-like projection adapted to clamp the neck of a bottle, the other end being either provided with an arcuate loop insertable about an integral prong extending downwardly form the base of the bottle, or provided with a prong insertable between a cup-like base and the exterior annular wall of the bottle thereby to secure the handle to the bottle.

In U.S. Pat. No. 3,021,026, there is disclosed a foldable bottle holder which comprises, when folded about a bottle, an upper portion intended to encircle the neck of a bottle, and a lower portion intended to fit with the bottom of the bottle.

In U.S. Pat. No. Des. 167,671, there is illustrated a holder for milk container comprising an upper rectangular strap intended to encircle a portion of the body of a milk container, a base intended to support the bottom of the milk container, a pair of parallel stems whose opposite ends respectively connect the strap with the base, and a handle integral with one of these stems.

Most of the above bottle holders which are designed to grasp a bottle, call for a simultaneous grasping of both ends of the bottle to be held (i.e. the neck and the base or the lower end of said bottle). This involves a mechanical fastening that can be tedious for the user. The holder of U.S. Pat. No. Des. 167,671, does not request any fastening: one has only to slip the milk container into the holder. However, this has the drawback of not providing for any grasping of the container. Moreover, none of existing bottle holders allow storage of a large bottle in a position other than upright.

SUMMARY OF THE INVENTION

A first object of the invention is to provide a holder for handling a container (especially a bottle) in which there is a single and very easy to perform grasping step (or ungrasping step), this step essentially consisting in fitting the container (especially a bottle) between at least one pair of resilient grasping arms (or pull the container (especially a bottle) out from between these arms).

Another object of the invention is to provide a holder which can be used for handling and eventually storing a container such as a large bottle especially a large bottle of soft drinks, which frequently have thin and flexible walls.

A further object of the invention is to provide a holder that is reusable, very easy-to-use and inexpensive to manufacture.

Still another object of the invention is to provide a holder for use to store a large container (especially a large bottle) into an inclined position with respect to a substantially horizontal surface so as to reduce the storing height needed in a storing room. (e.g. the space existing between two shelves in a refrigerator).

More particularly, the invention proposes holder for handling a container (especially a bottle) having a generally cylindrical body, this support comprising in combination:

a vertical stem having an upper portion and a lower portion, prehension means integrally projecting from the stem, supporting means integrally projecting from the lower portion of the stem in a direction opposite to the prehension means, the supporting means being intended to support the container, and grasping means comprising at least one pair of opposite arms made of a resilient material and extending above the supporting means, these arms integrally projecting from the stem and being intended to grasp and retain the body of the container when the container is fitted between the arms.

According to a particularly preferred embodiment of the invention, the support handle is provided with:

prehension means (especially a handle) consisting of an elongated member having opposite ends, one of these ends being integral and extending centrally with respect to the upper portion of the stem, the member being bent downwardly to have its other end positionned away from the stem and defining a first contact point, both ends of the elongated member extending in the same plane as the longitudinal axis; and the lower portion of the support is provided with at least two spaced apart second contact points symmetrical with respect to the longitudinal axis, the first and second contact points extending in a same plane and together defining a polygon, the distance between the first contact point and any of the second contact points being such that when all of these contact points are simultaneously in contact with a substantially horizontal surface, the center of gravity of an association comprising the support handle and a container, is above the aforesaid polygon.

The present invention will be better understood with reference to the following non-limitative description of preferred embodiment thereof, made with reference to the appended drawings.

DESCRIPTION OF A PREFERRED EMBODIMENT

Figure 1:
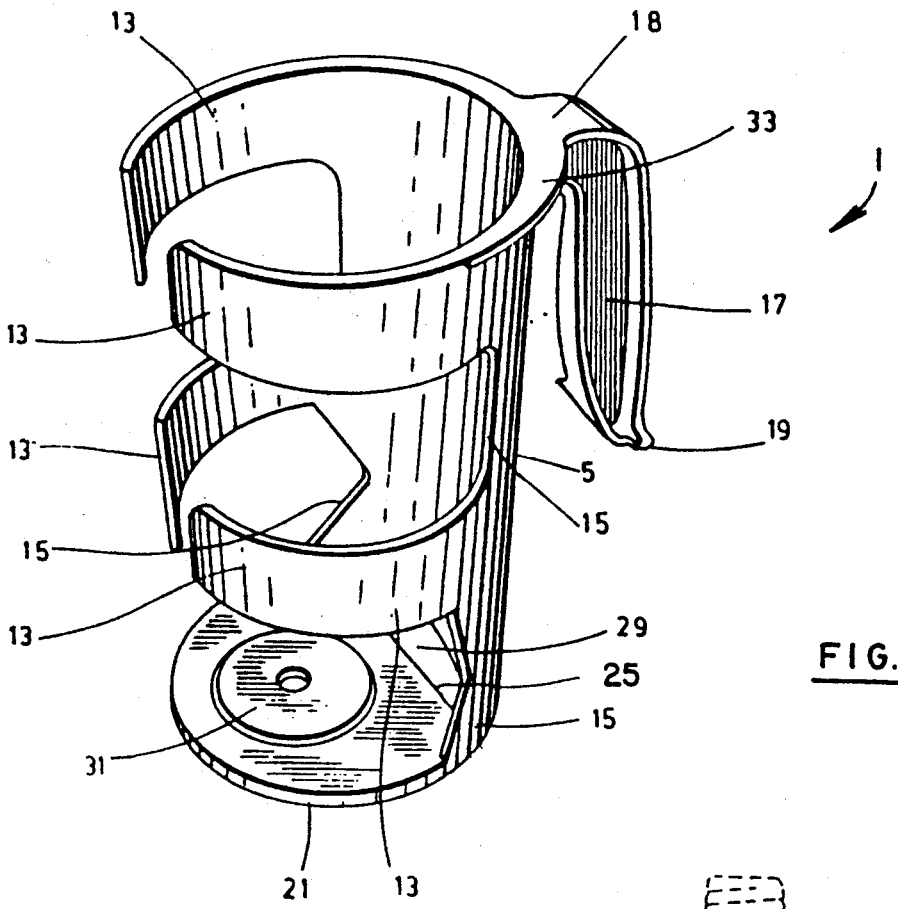
FIG. 1 is a perspective view of a support handle according to the invention.

The holder 1 according to the invention as shown in FIG. 1 is intended to be used for handling a container having a generally cylindrical body.

This holder 1 comprises in combination:

a vertical stem 5 having an upper portion and a lower portion, prehension means 17 integrally projecting from the stem 5, supporting means 21 integrally projecting from the lower portion of the stem 5 in a direction opposite to the prehension means, the supporting means being intended to support the container, and grasping means comprising at least one pair of opposite arms 13 made of a resilient material and extending above the supporting means, these arms 13 integrally projecting from the stem 5 and being intended to grasp and retain the body of the container, when the container is fitted between the arms 13.

Figure 2:
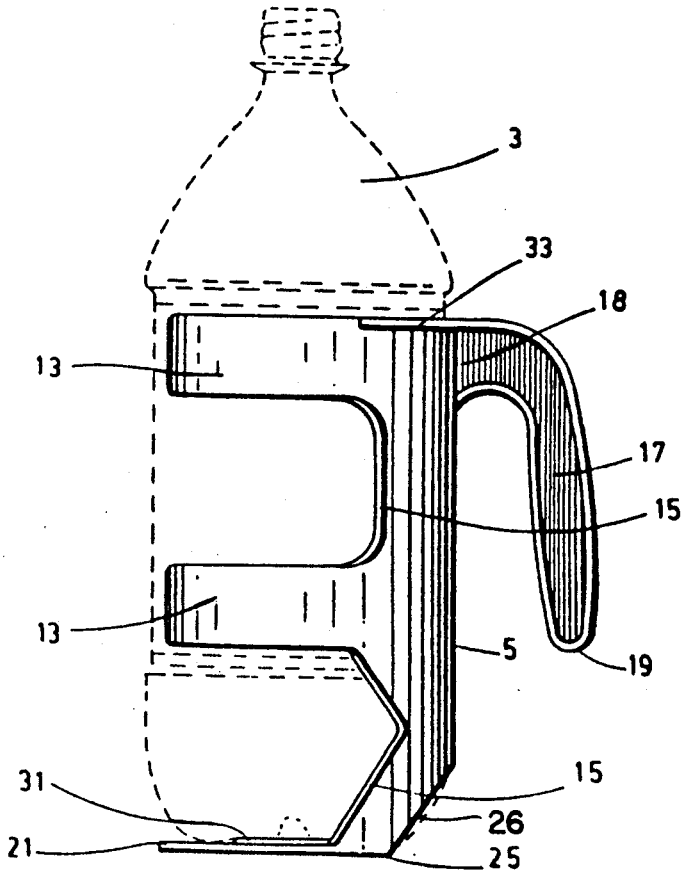
FIG. 2 is a side elevational view of the support handle of FIG. 1, in association with a bottle.
Figure 3:
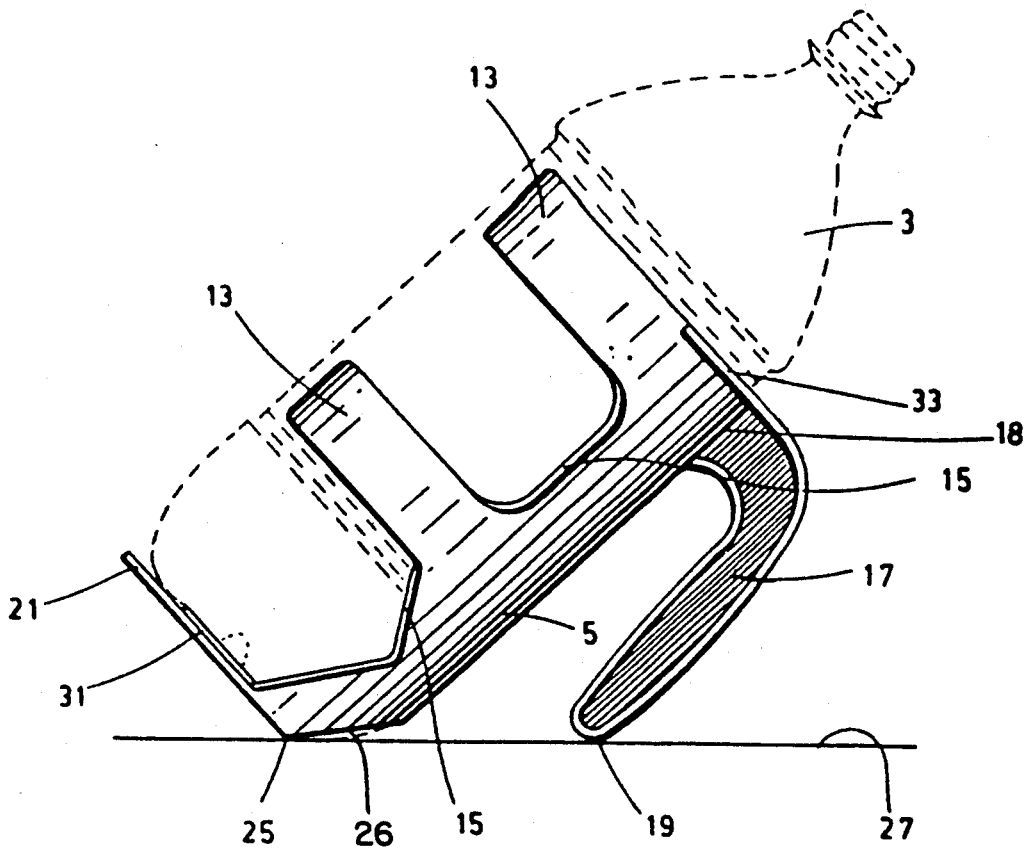
FIG. 3 is a side elevational view of the association of FIG. 2 tilted into a preferred storing position.

Preferably, the container, as represented in FIGS. 2 and 3, may be a bottle especially a bottle such as a large soft drink bottle 3 of the type provided with thin semi flexible side wall (e.g. a 2-liters or half-a-gallon soft drink bottle currently available on the market).

Advantageously, the stem 5 has a longitudinal axis and consists of a strip of resilient material having vertical edges 15. This strip is arcuate transversaly with respect to said longitudinal axis. Preferably this strip has such a radius of curvature as to match with the radius of the cylindrical body of the container or of the bottle 3.

As shown, the supporting means 21 preferably consists of a plate, preferably a circular plate, which extends perpendicularly to the stem 5.

The grasping means preferably comprise two pairs of opposite arms 13, the first pair of opposite arms integrally projecting from the upper portion of the stem 5 while the second pair of opposite arms 13 is integrally projecting from an intermediate portion of the stem 5.

Preferably, each arm 13 of the grasping means consists of a strip of resilient material having opposite ends, one of these ends being integral with the corresponding vertical edge 15 of the strip. Each arm 13 is arcuate transversally with respect to the longitudinal axis and has such a radius of curvature that when a bottle 3 (see FIGS. 2 and 3) is fitted in between the arms 13, the arc of each arm 13 is slightly disformed to increase its radius and thus follow the corresponding portion of the cylindrical body of the bottle 3.

Advantageously, the prehension means 17 consists of an elongated member having opposite ends. One of these ends, numbered 18 is integral and extends centrally with respect to the upper portion of the stem. The member 17 is bent downwardly to have its other end 19 positionned away from the stem. Both ends 18, 19 of the elongated member 17 extend in the same plane as the longitudinal axis of the stem 5. Preferably the elongated member 17 is shaped as a handle having its upper end integral to the upper portion of the stem 5. If desired, one or more crosspieces having opposite ends may be provided for, one of these ends of each crosspiece being integral with the stem 5 while the other end is integral with the elongated member 17.

According to a particularly preferred embodiment of the invention, as represented in FIGS. 1 to 3, the lower end of the stem 5 is angularly cut off to form a bevel 26 defining a base line 25 where it meets with the supporting plate 21. The bevel is inclined inwardly sufficiently so that when the holder is tilted with respect to a supporting surface 27, as in FIG. 3, it rests safely on surface 27 by its base line 25 and by the tip 19 of the handle 17 with the center of gravity of the holder and bottle assembly lying between the base line 25 and the tip 19. By the same token, the bevel 26 cuts out an aperture 29 through which the bottle 3 may protrude.

When the bottle 3 to be held has a recessed bottom, the circular plate 21 may also be provided with a small concentric protuberance 31. This protuberance 31 is intended to match with the recess in the bottom of a bottle 3 when this bottle is fitted in between said arms 13.

The bottle holder 1 may further be provided with a small reinforcing rib 33 integral with a top edge of the strip defining the stem 5.

Preferably, the circular plate 21, the stem 5, the arms 13 and the elongated member 17 are integral to each other and advantageously made with a resilient plastic material.

Manufacturing of above mentionned support handle 1 is achieved in any appropriate manner well known to a skilled workman. By way of example the support handle 1 may be obtained by injection moulding of a resilient plastic material such as polystyrene or polycarbonate. Of course, the size and thickness of the structural parts of the support handle 1 may vary within wide range. The skilled workman would easily determine these parameter with respect to the kind of material used and the kind of use to which said support handle is intended.

In order to use a bottle holder 1 according to the invention, one only have to carry out the following steps.

align the container to be held, such as a bottle 3, above the arms 13, the longitudinal axis of the container being in a same plane as the longitudinal axis of the support handle 1; and push the container (or bottle 3) downwardly between arms 13 until the bottom of the container (or bottle 3) contacts the supporting plate 21. When the container (or bottle 3) is pushed downwardly, the arms 13 are slightly put out of form until their radius of curvature match with the cylindrical body of the container (or bottle 3), thereby allowing the container to be positively grasp.

To remove the container (or bottle 3) from the support handle 1, one only has to reverse the above described procedure.

As can be seen in FIG. 3, the support handle 1 in association with a container (or bottle 3) may be tilted from a upright position into a storage position. To do so, the support handle 1 is tilted, with hands, around the bevel base line 25, to bring the tip 19 of its handle 17 against an horizontal surface 27 (see FIG. 3). Of course, the bottle holder 1 can be raised, still with hands, from its storage position back into its upright position. To do so, the above described procedure is reversed.

What is claimed is:

1. A holder for handling a bottle having a generally cylindrical body, said support comprising, in combination:

a vertical stem having an upper portion and a lower portion, prehension means integrally projecting from the stem, supporting means integrally projecting from the lower portion of said stem in a direction opposite to said prehension means, said supporting means being intended to support the bottle, grasping means comprising two pairs of opposite arms made of a resilient material and extending above said supporting means, said arms integrally projecting from the stem and being intended to grasp and retain the bottle when said bottle is fitted in between said arms;

wherein, said stem is provided with an intermediate portion, one of said pairs of arms integrally projecting from the upper portion of the stem while the other pair of opposite arms integrally projects from the intermediate portion of the stem, wherein the stem has a longitudinal axis and consists of a strip of resilient material having vertical edges, said strip being arcuate transversally with respect to said longitudinal axis, said strip having such a radius of curvature as to match the radius of the bottle cylindrical body, wherein each arm of the grasping means consists of a strip of resilient material having opposite ends, one of said ends being integral with the corresponding vertical edge of the strip, said arm being arcuate transversally with respect to said longitudinal axis and having such a radius of curvature that when the bottle is fitted in between said arms, the arc of each arms is slightly disformed to increase its radius and thus follow the corresponding portion of the cylindrical body, wherein the supporting means comprise a circular plate which extends perpendicularly to the stem, wherein the prehension means consist of a handle having an upper end integral with the upper portion of the stem, wherein the handle consists of an elongated member having opposite ends, one of said ends being integral and extending centrally with respect to the upper portion of the stem, said member being bent downwardly to have its other end positioned away from the stem, both ends of the elongated member extending in the same plane as said longitudinal axis;

wherein the lower end of the stem is angularly cut off to form a bevel having a base line where it meets with the holder circular plate; said bevel being inclined inwardly sufficiently so that the holder may be tilted to rest on a supporting surface by said base line and by the other end of said handle with the center of gravity of the holder and bottle assembly lying between said base line and said other end, wherein a part of the lower portion of the strip defining the stem and a part of the circular plate is cut off to define an aperture whose periphery define said second contact points.

2. A holder according to claim 1, wherein said bottle has a recessed bottom and wherein the circular plate is further provided with a small concentric protuberance, said protuberance being intended to match with the recess in the bottom of a bottle when said bottle is fitted in between said arms.

3. A holder according to claim 1, wherein a small reinforcing rib is integral with a top edge of the strip defining the stem.

4. A holder according to claim 1, wherein the stem, the circular plate and the handle are integral to each other and made of resilient plastic material.

* * * * *